United States Patent [19]

Keene

[11] Patent Number: 4,780,972

[45] Date of Patent: Nov. 1, 1988

[54] WHEELMOTOR DRIVE FOR ROTARY CUTTERHEAD

[76] Inventor: Wayne G. Keene, 933 Corbin Ave., Northridge, Calif. 91324

[21] Appl. No.: 170,989

[22] Filed: Mar. 21, 1988

[51] Int. Cl.[4] ..... E02F 3/18

[52] U.S. Cl. ..... 37/70; 37/189; 37/66; 277/135; 277/190

[58] Field of Search ..... 37/64, 66, 69, 70, 189, 37/DIG. 7; 277/1, 135, 190–191, 202

[56] References Cited

U.S. PATENT DOCUMENTS

| | | | |
|---|---|---|---|
| 3,010,232 | 11/1961 | Skakel et al. | 37/69 |
| 4,196,908 | 4/1980 | Rose et al. | 277/137 |
| 4,236,857 | 12/1980 | Willi | 37/70 |
| 4,239,124 | 12/1980 | Inouye | 277/190 X |
| 4,300,772 | 11/1981 | Nissel | 277/135 |
| 4,301,893 | 11/1981 | St. Jean et al. | 277/135 |
| 4,386,786 | 6/1983 | Agrama | 277/135 |
| 4,395,338 | 8/1983 | Neumann | 37/66 |
| 4,410,189 | 10/1983 | Myers et al. | 277/190 |
| 4,685,584 | 8/1987 | Ballard | 277/135 |

FOREIGN PATENT DOCUMENTS

| | | | |
|---|---|---|---|
| 1112463 | 8/1961 | Fed. Rep. of Germany | 37/189 |
| 1048034 | 12/1953 | France | 37/189 |
| 151758 | 11/1979 | Japan | 277/190 |
| 941763 | 7/1982 | U.S.S.R. | 277/135 |
| 14744 | 6/1907 | United Kingdom | 277/135 |

OTHER PUBLICATIONS

"The Ellicott Guarantee: Our Wheels Keep Turning", Adv. Lit. Dredging & Port Construction, Sep. 1987, Industrial & Marine Publications, Ltd., back cover.

Valmet Hydraulic Motors, Adv. Lit. 4-210 and 4-220, 2-15-86.

Dredging & Port Construction, Sep. 1987, pp. 32—33, Ref. L.

World Dredging & Marine Construction, Apr. 1986, Ref. M, See p. 11.

Rotary Power, MH Series of Low Speed High Torque Hydraulic Motors, Dec. 1985 Brochure, 4 pp., Ref. O.

*Primary Examiner*—E. H. Eickholt

*Attorney, Agent, or Firm*—Emmette R. Holman

[57] ABSTRACT

A wheelmotor direct-drives the bucketwheel for wet underwater service in dredging. This eliminates the combination of an intervening gear box and a water-tight chamber to house the rotating shaft hydraulic motor of conventional dry underwater service practice. In a preferred embodiment, a compression seal is provided which is adapted to create a chamber within the seal thereby providing a first line of defense against the intrusion of water into the junction of the stationary shaft and the rotating case. By injecting underwater lubricating grease into this chamber, displacing all of the air therein, the sliding contact surfaces are lubricated and a second line of defense against the intrusion of water is provided.

11 Claims, 2 Drawing Sheets

26
26
26
25
27
27
22
1
23
6
40
33
28
4
21
10
17
14
9
8
7
37
32
36
16
11
19
5
12
13
31
20
α
α
8
30
29
39
11
15
7
36
16
8
9
35
14
17
40
18
2
24
3
27
27
25
26
26
26

WHEELMOTOR DRIVE FOR ROTARY CUTTERHEAD

SUMMARY OF THE INVENTION

This invention relates to improvements in the cutterhead assembly of a dredge consisting of replacing the conventional rotating shaft hydraulic motor with a rotating case hydraulic motor, hereinafter designated as "wheelmotor", and direct-coupling the rotating case of the wheelmotor to the bucketwheel, thereby eliminating the water tight housing chamber and the intervening gearbox needed to protect the rotating shaft hydraulic motor according to the prior art practice.

In a preferred embodiment of the invention, a cylindrical theremoplastic compression seal is provided which is adapted to slidingly engage in compresion with its first end, the inboard flat, circular hub surface of the back plate terminating the sling and, with its second end to encircle and grasp the conical surface area of the rotating case of the motor wedged in the second end. Thereby a watertight enclosed space is created within the compression seal to house the junction of the stationary shaft and the rotating case of the motor as a first line of defense against corrosive water and abrasive mud intrusion into the motor bearings. Furthermore, underwater lubricating grease may be injected with a grease gun via a grease compression fitting screwed into the wall of the compression seal to completely fill the enclosed space and displace all air, whereby is provided a second line of defense against water and mud intrusion while, at the same time, the slidingly engaged interface of the compression seal/back plate contact area is lubricated.

BACKGROUND OF THE INVENTION

The term wheelmotor, as used hereinafter, applies to a hydraulic motor with a rotating case and a stationary shaft. A hydraulic motor is a multicylinder radial piston engine driven by recirculating hydraulic fluid under high pressure. Wheelmotors are used, for example, to drive conveyor belts, bulldozers, excavators, other construction equipment and, by the airlines, to drive the tow trucks that maneuver aircraft in their hangars. The wheelmotor accordingly is not a new device but, to my knowledge, it has not previously been used "wet" in underwater service, notably, to drive the cutter head of a dredge.

The more familiar rotating shaft hydraulic motor, on the other hand, has been used exclusively to drive the bucketwheels of dredges of the prior art. These latter motors may be mounted on deck, above water, remote from the bucketwheel to which they connect by a power train of shaft- or chain- drive interlinked by gear box or their sprocket equivalents. These motors are also used for "dry" underwater service, in which case they are housed in a watertight dry chamber where they are spaced from the bucketwheel hub itself by an intervening gearbox filled with oil under pressure to avoid the intrusion of water, as is recited by John A. Neumann in U.S. Pat. No. 4,395,833, dated Aug. 2, 1983.

Now I have discovered that the VALMET TM wheelmotor, manufactured by Valmet Hydraulics, Sulantie 19, SF-04300 HYRYLA, Finland, and sold in the U.S.A. under the brand name Black Bruin TM by the distributor, North American Hydraulics, Inc., P.O. Box 40062, Houston, Tex., 77240, is eminently suited for wet operation under water in contrast to the above described dry underwater operation with rotating shaft motors in the prior art.

Although my experience with the Black Bruin TM and other wheelmotors in wet underwater service, absent optional added protection from water intrusion, has been favorable so far, I am mindful, nevertheless, of the history of eventual failure of rotating shaft hydraulic motors due to corrosion and excessive wear induced by water and abrasive mud ingested into the motor bearings under these conditions. It is believed that the bearing seal in the wheelmotor is superior to that in the rotating shaft motor, but in any event, the bearing seal is the last line of defense against water intrusion. Accordingly, in a preferred embodiment of the invention I provide first and second lines of defense against water intrusion consisting respectively, of:

1. a compression seal, essentially a thick-walled cylinder, adapted to be lodged in longitudinal compression against the peripheral annular portion of the inboard flat, circular, hub surface of the back plate surrounding the stationary shaft part of the wheelmotor with its first end in sliding engagement therewith and, with its second end to encircle and firmly grasp the substantial conical surface area of the rotating case of the wheelmotor wedged in the second end, whereby the seal rotates in locked engagement with the case and encloses a watertight compartment around the junction of the stationary shaft and the rotating case. And 2. a threaded hole in the wall of the compression seal adapted to interchangeably and alternately receive a grease compression fitting or an Allen head plug, whereby all of the air enclosed within the compartment can be expelled with pressurized grease from a grease gun, and thereafter the grease fitting is replaced by the plug.

The Black Bruin TM wheelmotor is fortuitously provided with a prominent and substantial conical surface area which converges toward the stationary shaft end of the motor. This simplifies the practice of the preferred embodiment of the invention. A competitive wheelmotor offered by Rotary Power also provides the desired conical surface. Although it is relatively stubbier and larger in diameter, a compression seal can be adapted to accommodate it by changing the dimensions as well as by adopting a new more suitable surface of revolution shape, such as the frustum of a cone, a horn or a sphere, etc.

PRESENTATION OF THE DRAWINGS

DETAILED DESCRIPTION

Figure 1:
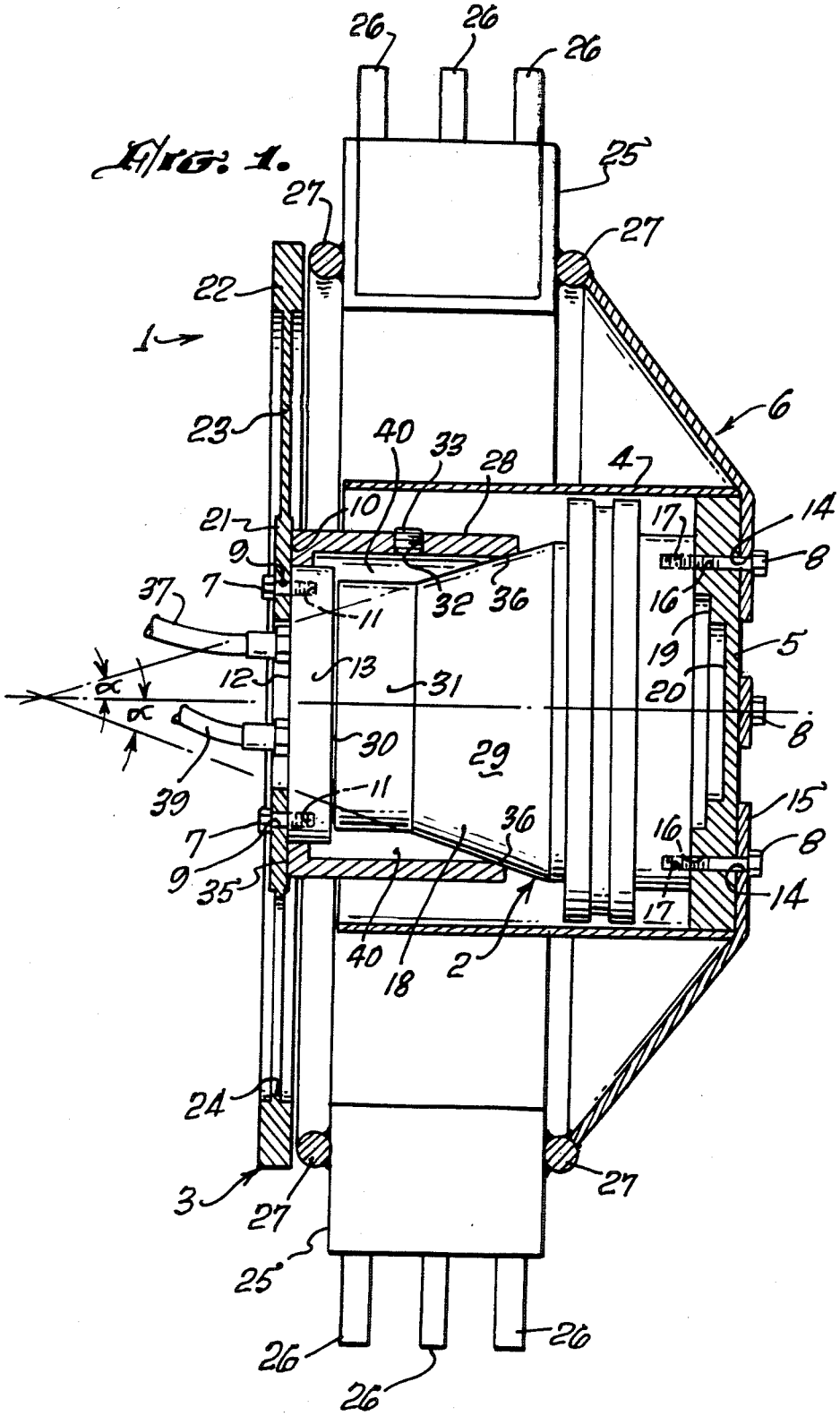
FIG. 1 shows the herein disclosed cutterhead assembly in section along its axis of rotation, with the wheelmotor in elevation.

Referring to the drawings, the cutterhead assembly, generally indicated as 1, is a combination of: wheelmotor, generally indicated as 2, back plate, generally indicated as 3, shield drum 4, shield drum flange 5, bucketwheel, generally indicated as 6, and the pluralities of bolts 7 and 8 which secure these components together into an integrated assembly. Back plate 3 is the bottom terminus of the sling and does not rotate on the axis of the cutterhead assembly. The remainder of the sling, which articulates from the boom of the dredge, is conventional in the art and hence is not shown.

Each bolt 7 passes through a corresponding hole 9 in the inboard flat circular hub surface 10 of back plate 3 and securely engages correspondingly aligned threaded mounting hole 11 in the flat flange face 12 of stationary shaft part 13 of wheelmotor 2. The pluralities of bolts 7 and 8 are at least two bolts in each case, but preferably six or more bolts. Pluralities 7 and 8, each of four bolts, respectively, are actually shown in the drawings.

Each bolt 8 passes first through a corresponding hole 14 in hub 15 of bucketwheel 6, next through correspondingly aligned hole 16 in shield drum flange 5, to threadedly engage correspondingly aligned threaded mounting hole 17 in rotating case 18 of wheelmotor 2. As best seen in FIG. 1, shield drum flange 5 is provided, inboard, with a stepped circular recessed cavity, the annular step surface 19 and the flat bottom surface 20 of which are adapted to nestingly receive the corresponding annularly stepped contour of the rotating case 18. Conseqeuntly, all of these latter elements of the bucketwheel 6 subcombination rotate with case 18 as an integrated unit about the axis of the stationary shaft part 13 of wheelmotor 2.

Back plate 3 is composed of three integrated component sections; hub 21, a stiffening rim 22 and an intermediate web 2 which web, preferably, is predominantly a foraminated screen. A large diameter suction orifice 24 is provided in the lowest reaches of web 23. During operation, the bucketwheel 6 rotates clockwise, as viewed in FIGS. 2 and 3, so that the teeth 26 of buckets 25 seen in FIG. 1, bite into the sedimentary stratum, breaking it up and raking the detritus into the buckets 25, which scoop it up. As each bucket climbs in its circular orbit, it inverts and dumps its load of detritus into the churning volume of water within bucket wheel 6. The falling detritus and mud suspension is sucked out via the orifice 24 in the web 23 of back plate 3 and is piped overboard, for example, into a barge (not shown) as is well understood in the art.

Figures 2, 3, 4:
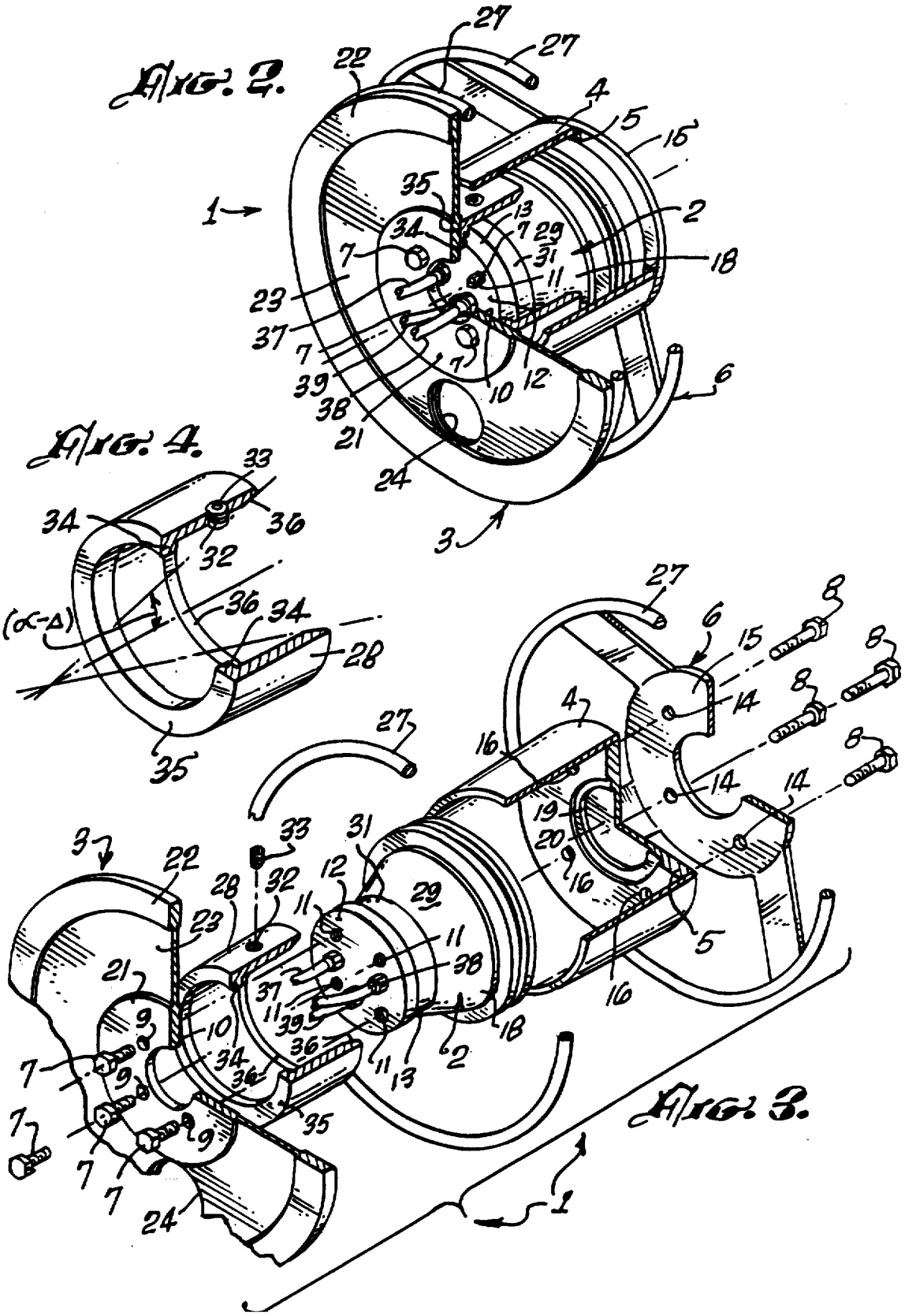
FIG. 2 is an isometric view of FIG. 1, partly in section, showing portions within in elevation.
FIG. 3 is an exploded view of FIG. 2 with portions broken away.
FIG. 4 is an isometric view of the preferred embodiment of the compression seal, partly in section.

To simplify the drawings for purposes of better clarity in the disclosure, the conventional buckets 25 of FIG. 1, each with its three teeth 26, are not shown in FIGS. 2 & 3 and the bucketwheel 6 is schematically indicated therein by its two rim hoops 27, spokes and hub 15.

In the preferred embodiment of the invention, a compression seal 28 is lodged coaxially of the stationary shaft part 13 in longitudinal compression, between inboard flat circular hub surface 10 of back plate 3 and substantial conical surface area 29 of rotating case 18, whereby it encloses, watertight, the junction 30 of the stationary shaft part 13 and the cylindrical nose section 31 of rotating case 18. This enclosure by the compression seal 28 provides a first line of defense against the intrusion of water and mud into the junction 30 and thence past existing water seals (not shown) into the motor bearings (not shown), which would lead to the ultimate destruction of the wheelmotor 2.

A threaded hole 32, adapted to receive, alternately and interchangeably, a compression grease fitting, not shown, and an Allen head plug 33, is provided in the wall of the compression seal 28 as a preferred option. With the grease fitting in place, underwater lubricating grease may be injected with a grease gun into the enclosed space within the compression seal, displacing all pockets of air, whereby to provide a second line of defense against the intrusion of corrosive water and abrasive mud ultimately into the motor bearings.

The compression seal 28 is a thick walled sleeve in the shape of a circular cylnder, or other surface of revolution, e.g., a truncated-cone, -horn, -bowl, etc., that is adapted to fit the geometry of the wheelmotor 21. It is provided at its first end with an inwardly directed flange 34 with a flat face 35 and at its second end with an outwardly diverging, conical bevel surface 36 in its interior wall. The compression seal 28 is made of tough, impact- and wear- resistant, thermoplastic polymeric resin, such as polyethylene, polypropylene, their copolymers, etc.

The typical wall thickness is about 0.5 inch; the annular band width across flat face 35 is about 0.75 inch; and the height of the bevel surface cone 36 is about 0.5 inch. The angle $(\alpha-\Delta)$ of the conical bevel surface 36 with its axis is, preferably, smaller than the corresponding angle $\alpha$ of the substantial conical surface area 35 which it engages, by a differential angle $\Delta$=about 4°. The same compression seal 28 fits both of the two Black Bruin wheelmotor sizes, 400 $cm^3$ and 800 $cm^3$, that I have used to drive bucketwheels. The overall length of the cylinder is about 4.125 inches. The outside diameter is about 7.5 inches. The inside diameter of the flange opening is about 6 inches which, however, is secondary, inasmuch as it must clear the outside diameter of stationary shaft part 13. The bevel surface cone angle $(\alpha-\Delta)$ reduces the wall thickness by about 0.125 inch as measured diametrically across the second end of compression seal 28.

The differential angle, $\Delta$=about 4°, between the two cone angles assures that the conical bevel surface 36 first contacts the conical surface area 29 with the very outermost rim of the bevel surface 36, where the wall thickness of compression seal 28 is minimum.

The circumferential tensile stress is concentrated at the outermost rim of 36 which, being where the wall cross section is thinnest, it yields by stretching in secondary tension most readily for better comformity of this very narrow band of interfacial contact of bevel surface 36 with the conical surface area 29, under axial compression during assembly by the tightening of the plurality of bolts 7. This provides a tight grasp of the conical bevel surface 36 on the conical surface area 29 to lockingly engage it as well as to provide the best first line of defense against the intrusion of corrosive water and abrasive mud suspension into the bearings of wheelmotor 2 at this second end of the compression seal 28.

At the first end of compression seal 28, however, flat face 35 of inwardly directed flange 34 engages the inboard flat, circular hub surface 10 of back plate 3 over a much larger annular area of sliding contact. Hence the resulting interfacial pressure per unit area is low at the first end as compared with the second end of 28. In this respect, accordingly, the protection from the intrusion of water is proportionately inferior at the first end to that at bevel surface 36 at the opposite end of compression seal 28. This problem is corrected by displacing all pockets of air from within the chamber 40, created within compression seal 28, with a charge of pressurized underwater lubricating grease as has already been described. During the charging with pressurized grease, the surplus grease will ooze out through the interface at 35 at the first end, lubricating it for the intended sliding contact and providing at the same time a second line of defense against the intrusion of water and mud into the bearings of wheelmotor 2. Thereupon, for wet underwater service, the compression grease fitting is replaced by plug 33. However, if the grease fitting is the waterproof kind, such as a Zerk TM fitting, it can remain in place and it is not necessary to replace it with plug 33. Additional fresh grease is injected every six months. Easy access to the grease fitting for this purpose then requires removing the plurality of bolts 8 and dropping the bucketwheel 6 plus shield 4 with its integrated flange 5.

A pump (not shown) on deck receives from- and delivers hydraulic fluid to- a four way control valve (not shown), respectively via high pressure hydraulic lines (not shown). Two interchangeably alternate "high/low" pressure hydraulic lines, 37, 38, shown broken away in FIGS. 2 and 3, engage corresponding two of three ports (not shown) in flat fange surface 12. Lines 37, 38 convey the hydraulic fluid to and from the wheelmotor, respectively, alternately reversing the flow for clockwise or counter-clockwise rotation, depending on the optional disposition of the four way control valve. The remaining third one of these three ports is engaged by hydraulic fluid return line 39, shown broken away in FIGS. 2 and 3, which connects to an inlet port (not shown) in the hydraulic fluid reservoir tank (not shown) on deck. Line 39 drains the surplus hydraulic fluid that tends to accumulate in the rotating case 18 to prevent the build up of excessive internal pressure therein.

I claim:

1. In a cutterhead assembly for a dredge having on deck:

a hydraulic pump with inlet and outlet ports;

a hydraulic fluid reservoir tank with inlet port;

a four way control valve with four ports, for reversal of flow of hydraulic fluid with optional alternate dispositions thereof corresponding to clockwise and counterclockwise rotation, respectively, of the bucketwheel of said cutter head assembly;

a pair of high pressure hydraulic lines each connecting outlet and inlet ports, respectively, of said pump with corresponding inlet and return ports, respectively, in the inlet side of said four way control valve;

first and second outlet ports in the outlet side of said four way control valve connected to first and second hydraulic lines, respectively;

a hydraulic fluid return line connected to an inlet port of said reservoir tank; an articulated boom on said dredge, with a sling on the free end of said boom, said sling being provided at its lower terminus with a back plate which is adapted to support and maneuver on the inboard side of said back plate a bucketwheel, said cutterhead assembly consisting of said back plate as the first element and said bucketwheel as the ultimate element of a power train;

the improvement consisting of providing in said power train;

(a) a flat, circular hub surface on said inboard side of said back plate, coaxial with and facing said bucketwheel;

(b) a wheelmotor having a stationary shaft part and a rotating case, said stationary shaft part having a flat flange surface adapted to abut and to be coaxially secured to said flat circular hub surface on said back plate by a first plurality of bolts, said flat flange surface of said stationary shaft part occupying the center portion of said flat, circular hub surface on said back plate leaving unoccupied, a peripheral annular portion surrounding said occupied center portion;

(c) bucketwheel with hub adapted to be affixed coaxially to said rotating case of said wheelmotor by a second plurality of bolts;

(d) an array of three ports in said flat flange surface of said stationary shaft part, the first and second ports of said array of three ports being connected by said first and second hydraulic lines to said first and second outlet ports, respectively, in said inlet side of said four way control valve; and (e) the third port of said array of three ports being adapted to receive said hydraulic fluid return line connecting to said inlet port of said hydraulic fluid reservoir tank;

whereby said wheelmotor direct-drives said bucketwheel while wet under water, absent protection of dry chamber with gearbox, form the intrusion of water into bearings of said wheelmotor.

2. In the cutterhead assembly according to claim 1, wherein the rotating case of said wheelmotor is provided with a substantial conical surface area, said conical surface providing a range of diameters including diameters exceeding the outside diameter of said stationary shaft part, said conical surface area being coaxial with and converging toward said stationary shaft part.

3. In the cutterhead assembly according to claim 2, the improvement consisting of providing a circular sleeve-shaped thermoplastic compression seal lodged coaxially in longitudinal compressiom against said unoccupied peripheral annular portion of said flat, circular hub surface on said back plate surrounding center portion occupied by said stationary shaft part at a first end of said compression seal and, at a second end thereof, encircling said conical surface area of said rotating case wedged in said second end, said compression seal completely enclosing the junction of said stationary shaft part and said rotating case, whereby a watertight chamber is created within said compression seal to serve as a first line of defense against the intrusion of water and abrasive mud into the bearings of said wheelmotor.

4. In the cutterhead assembly according to claim 3, wherein said compression seal is provided in the shape of a surface of revolution about its axis of rotation and has a nominal wall thickness of about 0.5 inch.

5. In the cutterhead assembly according to claim 4, wherein a threaded hole in the wall of said compression seal is provided, said threaded hole being adapted to receive, interchangeably, a plug and a grease compression fitting, whereby said watertight chamber can be filled with underwater lubricating grease under pressure through said grease compression fitting engaged in said threaded hole and then sealed by replacing said grease compression fitting in said threaded hole with said plug, thereby to provide lubrication at said first end of said compression seal plus a second line of defense against the intrusion of water and abrasive mud into the bearings of said wheelmotor.

6. In the cutterhead assembly according to claim 5, wherein said grease compression fitting is waterproof and remains permanently installed in said threaded hole, whereby the need to interchange said grease compression fitting in said threaded hole with said plug in every lubrication procedure is eliminated.

7. In the cutterhead assembly according to claim 6, wherein an inwardly directed flange in said first end of said compression seal is provided, said flange being oriented in a plane normal to said axis of rotation and having an inside diameter sufficient to clear the outside diameter of said stationary shaft part, whereby the end face of said flange is adapted to slidingly engage said unoccupied peripheral annular portion surrounding said occupied center portion of said flat, circular hub surface on said back plate.

8. In the cutterhead assembly according to claim 7, the improvement consisting of providing an outwardly diverging conical bevel in the interior surface of said compression seal at said second end of said compression seal, opposite said flange first end thereof, whereby said outwardly diverging conical bevel surface is adapted, under said longitudinal compression, to stretch and tightly grasp in locked engagement, said substantial conical surface area of said rotating case wedged in said second end, to create a water tight seal and to rotate therewith.

9. In the cutterhead assembly according to claim 8, wherein said outwardly diverging conical bevel in the interior surface of said compression seal forms an angle $(\alpha-\Delta)$ with said axis of rotation, where $\alpha$ is the corresponding angle of said substantial conical surface area of said rotating case and where the differential angle $\Delta$ is about 4 degrees, whereby said stretch and grasp on said substantial conical surface area of said rotating case wedged in said second end is appreciably enhanced.

10. In the cutterhead assembly according to claim 9, wherein said surface of revolution about its axis of rotation of said compression seal is a right circular cylinder.

11. In the cutterhead assembly according to claim 10, wherein said first and second pluralities of bolts are each pluralities of at least two bolts.

* * * * *

UNITED STATES PATENT AND TRADEMARK OFFICE

CERTIFICATE OF CORRECTION

PATENT NO. : 4,780,972

DATED : Nov. 1, 1988

INVENTOR(S) : Wayne G. Keene

It is certified that error appears in the above-identified patent and that said Letters Patent is hereby corrected as shown below:

Insert Sheet 2 of the drawings containing Figs. 2, 3 and 4, as shown on the attached sheet.

On the Title Page, Item [76], in the inventor's address, change "933" to --9330--.

Col. 1, line 16, change "theremoplastic" to --thermoplastic--.

Col. 1, line 17, change "compresion" to --compression--.

Col. 3, line 23, change "conseqeuntly" to --consequently--.

Col. 3, line 28, change ";" to --:--.

Col. 3, line 29, change "2" to --23--.

Col. 4, line 5, change "cylnder" to --cylinder--.

Col. 4, line 7, change "21" to --2--.

Col. 5, line 17, change "fange" to --flange--

Claim 1, col. 5, line 58, change ";" to --:--.

Claim 1, col. 6, line 4, insert "a" between "(c)" and "bucketwheel".

UNITED STATES PATENT AND TRADEMARK OFFICE

CERTIFICATE OF CORRECTION

PATENT NO. : 4,780,972

DATED : Nov. 1, 1988

INVENTOR(S) : Wayne G. Keene

It is certified that error appears in the above-identified patent and that said Letters Patent is hereby corrected as shown below:

Claim 1, col. 6, line 11, change "inlet" to --outlet--.

Claim 1, col. 6, line 19, change "form" to --from--.

Signed and Sealed this

Twenty-first Day of March, 1989

*Attest:*

*Attesting Officer*

DONALD J. QUIGG

*Commissioner of Patents and Trademarks*